US012031381B2

(12) United States Patent
MacKay

(10) Patent No.: US 12,031,381 B2
(45) Date of Patent: Jul. 9, 2024

(54) SERVICE CONNECTOR

(71) Applicant: Engineering Innovation & Design Limited, Aberdeen (GB)

(72) Inventor: Alexander Craig MacKay, Aberdeen (GB)

(73) Assignee: ENGINEERING INNOVATION & DESIGN LIMITED, Aberdeen (GB)

( * ) Notice: Subject to any disclaimer, the term of this patent is extended or adjusted under 35 U.S.C. 154(b) by 64 days.

(21) Appl. No.: 17/051,695

(22) PCT Filed: Apr. 29, 2019

(86) PCT No.: PCT/GB2019/051184

§ 371 (c)(1),
(2) Date: Oct. 29, 2020

(87) PCT Pub. No.: WO2019/211589

PCT Pub. Date: Nov. 7, 2019

(65) Prior Publication Data

US 2021/0222499 A1 Jul. 22, 2021

(30) Foreign Application Priority Data

Apr. 30, 2018 (GB) ..... 1807031

(51) Int. Cl.
*E21B 10/28* (2006.01)
*E21B 10/30* (2006.01)
(Continued)

(52) U.S. Cl.
CPC ..... *E21B 10/28* (2013.01); *E21B 10/30* (2013.01); *E21B 17/042* (2013.01); *E21B 17/1064* (2013.01)

(58) Field of Classification Search
CPC ..... E21B 17/042; E21B 17/046
See application file for complete search history.

(56) References Cited

U.S. PATENT DOCUMENTS 3,754,609 A * 8/1973 Garrett ..... E21B 17/042 175/323
4,082,373 A 4/1978 Kellner
(Continued)

FOREIGN PATENT DOCUMENTS

GB 743 162 A 1/1956
GB 843163 A 8/1960
(Continued)

OTHER PUBLICATIONS

European Exam Report issued on Aug. 11, 2021 for European Application No. 19721373.9, 7 pages.
(Continued)

*Primary Examiner* — Theodore N Yao
(74) *Attorney, Agent, or Firm* — Klintworth & Rozenblat IP LLP

(57) ABSTRACT

A downhole tool, comprising: a mandrel having first and second opposing ends and an outer mounting surface, the first end comprising a male threaded portion; a tool component mountable on the mounting surface by sliding said tool component onto the mounting surface from the first end of the mandrel; and a load sleeve defining a torque shoulder, wherein the load sleeve is mountable on the mandrel and securable adjacent the male threaded portion of the first end of the mandrel such that the torque shoulder and the male threaded portion define a pin connector to facilitate connection with a box connector of a separate component.

14 Claims, 7 Drawing Sheets

(51) Int. Cl.
*E21B 17/042* (2006.01)
*E21B 17/10* (2006.01)

(56) References Cited

U.S. PATENT DOCUMENTS

| | | | | |
|---|---|---|---|---|
| 4,655,479 | A * | 4/1987 | Farr, Jr. | E21B 17/04 192/56.6 |
| 5,743,333 | A * | 4/1998 | Willauer | E21B 33/1277 166/134 |
| 2013/0146305 | A1* | 6/2013 | Dupal | E21B 17/046 166/380 |
| 2015/0129309 | A1* | 5/2015 | Anderson | E21B 3/00 175/57 |
| 2017/0226843 | A1* | 8/2017 | Jovancicevic | G01N 17/046 |
| 2018/0252049 | A1* | 9/2018 | Stack | E21B 17/003 |
| 2018/0305985 | A1* | 10/2018 | Steine | E21B 17/046 |
| 2021/0396080 | A1* | 12/2021 | Cockrill | E21B 33/1277 |

FOREIGN PATENT DOCUMENTS

| | | | |
|---|---|---|---|
| SU | 632 822 | A1 | 11/1978 |
| WO | 01/31163 | A1 | 5/2001 |
| WO | 2012/006455 | A | 1/2012 |
| WO | 2014/138844 | A1 | 9/2014 |
| WO | 2016/108844 | A | 7/2016 |

OTHER PUBLICATIONS

Combined Search Report and Examination Report for German Patent Application No. GB1807031.8 dated Sep. 11, 2018, 5 pages.
International Search Report and Written Opinion for International Patent Application No. PCT/GB2019/051184 dated Jul. 22, 2019, 26 pages.

* cited by examiner

SERVICE CONNECTOR

FIELD

The present disclosure relates to a downhole tool, specifically to a downhole tool which includes a service connector.

BACKGROUND

Downhole equipment typically comprises a series of tools connected in series to form a "string". Such strings require at least one "service-break" to assemble tool components of the string, or assemble or disassemble the string as a whole. The plurality of tools forming the string are thus connected by connectors such as service connectors. These connectors typically comprise engageable male and female threaded portions, for example in the form of a pin and box connector, and allow components to be connected and disconnected to assemble and disassemble the string as required. The connectors used in such service connectors are frequently in accordance with American Petroleum Institute standards.

In order to transmit axial or torsional loads along the string (for example a drill string), connectors will often include a torque shoulder integrally formed on both parts of the connector. Each torque shoulder may define a load surface, which abut and engage one another during connection of the connector. These abutting load surfaces allow torsional and axial loads to be efficiently transferred across the connection.

For convenience and load-transfer properties, the torque shoulders are generally located towards the outside of the components and typically extend radially out from the connector threads. Accordingly, they increase the required diameter of the connectors above the maximum thread diameter. This can restrict the design of the tools used in strings, as tool components which need to be attached and detached from the downhole tool need to fit over the outer diameter of the torque shoulder. This can in turn restrict the annular clearance and the flow-by area between the outer surface of the tool and the bore of the hole.

SUMMARY

An aspect of the present disclosure relates to a downhole tool, comprising: a mandrel having first and second opposing ends and an outer mounting surface, the first end comprising a male threaded portion; a tool component mountable on the mounting surface by sliding said tool component onto the mounting surface from the first end of the mandrel; and a load sleeve defining a torque shoulder, wherein the load sleeve is mountable on the mandrel and securable adjacent the male threaded portion of the first end of the mandrel such that the torque shoulder and the male threaded portion define a pin connector to facilitate connection with a box connector of a separate component.

The downhole tool provides the formed pin connector. The male threaded portion and the torque shoulder of the load sleeve may define a service connector within the downhole tool. The male threaded portion and torque shoulder may define one half of a service-break. Such a service connector may be provided in such a manner to facilitate assembly, maintenance etc. of the downhole tool, without or with minimal compromise to the ability of the tool to be connected to separate components in a robust manner.

The service connector provided by the formed pin connector may be used to directly connect the downhole tool to a separate component, such as a tool string component, tubing string component, and the like, for example during the process of making up a tool or tubing string in the field. Alternatively, the service connector provided by the formed pin connector may facilitate connection with a connector sub, which may permit connection of the downhole tool to a separate component.

The first end of the mandrel may comprise only the male threaded portion, with no separate load-bearing shoulder being required. As such, the outer dimension of the first end of the mandrel may be dictated by the diameter of the male threaded portion and thus may be smaller than equivalent end-dimensions in traditional tools.

The male threaded portion may form the pin connector of a service connector. The male threaded portion may be tapered. The pin connector may be in accordance with an American Petroleum Institute (API) standard. This may allow the downhole tool to interface with a range of existing string components and be included as part of a tubing string.

The pin connector may be formed by the assembly of the downhole tool, that is, by mounting the load sleeve on the mandrel—for example the mounting surface thereof. This allows the pin connector to be provided after a tool component has been mounted on the mounting surface. As such, the pin connector may not be fully formed when the tool component is mounted on the mounting surface, providing greater flexibility in terms of tool component design and the range of applications of the downhole tool.

The tool component may be any suitable tool component for use downhole. The mounting surface may be arranged to receive a range of tool components. The tool component may define the function of the downhole tool. The provision of said mounting surface for the mounting of tool components, which may subsequently be dismounted and replaced, provides increased freedom when designing tool components and facilitates reuse of the downhole tool.

The load sleeve may be secured on the mandrel such that it can efficiently transfer axial and torsional loads—via the torque shoulder—to the mandrel from the separate component connected to the pin connector. The load sleeve may be securable on the mandrel such that it holds the tool component in place on the mounting surface. As such, the load sleeve may have dual functionality of providing the torque shoulder for the pin connector and securing the tool components on the mounting surface.

It is to be understood that any feature described herein as "locatable" may instead be "located". Similarly, a feature described as "securable" may be "secured" (and vice versa).

The mandrel may be cylindrical. The mandrel may be tubular. The mandrel may be made of any material known to be suitable for use in downhole operations.

The mandrel may be arranged to allow fluid to flow therethrough, between the first and second ends, in either direction. The second end of the mandrel may comprise a male or female connector, for example a female box connector. This may allow the downhole tool to be used as part of a drill string or a completion string and be connected to and interface with existing tubular string components.

The mandrel may comprise a stress relief groove adjacent the first end, for example comprising a radiused and/or chamfered corner, in order to avoid stress concentrations during use of the tool.

The mounting surface may form part of the outer surface of the mandrel. The mounting surface may constitute part of, or the whole of, the external surface of the mandrel.

The mounting surface may have a reduced diameter or outer radial profile compared to the rest of the mandrel. A shoulder may be defined at an edge of the mounting surface, e.g. at the interface between the mounting surface and an adjacent mandrel surface. The shoulder may be arranged to abut tool components mounted on the mounting surface in order to locate and axially secure the tool components, without the need for further components.

The mounting surface may be arranged to receive the tool component for attachment to the downhole tool. The mounting surface may be configured to receive, support, engage and/or secure the tool component. The mounting surface may also be configured to receive the load sleeve, or locking assembly (see below).

The mandrel and/or mounting surface may comprise a surface feature for receiving, locating and/or securing the tool component, load sleeve and/or locking assembly—for example indentations, protrusions, grooves, ridges cut-outs, slots and/or keyways.

The mandrel and/or mounting surface may have a circular cross-section, or a non-circular cross section. The radial profile of the mandrel and/or mounting surface may be arranged to engage the tool component, load sleeve and/or locking assembly and restrict relative rotation.

The mounting surface may be configured to ensure that it does not constitute the weakest cross-section of the mandrel for transferring axial or torsional loads. As such, the thickness and profile of the mounting surface may be configured to ensure it is not responsible for reducing the overall tensile or torsional strength of the tool.

The load sleeve may be mountable on the mandrel and/or the mounting surface thereof. Any discussion herein regarding the mounting of the load sleeve on the mandrel applies, mutatis mutandis to the mounting surface of the mandrel.

The load sleeve may be independent to the mandrel. The load sleeve may be separable with respect to the mandrel and the rest of the tool and thus attachable and detachable therefrom. This allows the load sleeve to be removed from the tool when the tool components are mounted on the mounting surface and subsequently secured on the tool to provide the pin connector. The load sleeve can then subsequently be removed from the mandrel to disassemble the tool, if required.

The load sleeve may be tubular. The load sleeve may comprise an internal bore which may be circular or may be non-circular—for example to match and engage with a non-circular outer profile of the mandrel. The internal bore of the load sleeve for receiving the mandrel may be located centrally and symmetrically within the load sleeve, or asymmetrically within the load sleeve.

The load sleeve may be formed of a plurality of parts. These parts may be mountable on the mandrel separately. The load sleeve may thus be assembled on the mandrel. The load sleeve may alternatively be slidable onto the mandrel, for example from the first end or second end, as a single component.

The load sleeve may be for facilitating load transfer between the tool and the separate component to which it is connectable. Accordingly, the load sleeve may define the torque shoulder for engagement with the separate component and transferring loads therebetween. The torque shoulder provided by the load sleeve may form part of the service connector and may thus facilitate robust connections with standard (e.g. API) connectors.

The torque shoulder may comprise a load surface arranged to abut a load surface of the separate component and transfer axial and/or torsional loads therebetween. The load surface may be an axially-facing end face of the load sleeve which may be adjacent the first end of the mandrel when the load sleeve is secured on the mandrel.

The tool may be configured such that the load surface abuts a corresponding surface of the separate component when the male threaded portion engages the corresponding box connector of the separate component. A tip surface (axially-facing) of the threaded portion may be configured to abut an internal, axially-facing, surface of the box connector of the separate component. The tip surface and internal surface of the box connector may provide secondary load transferring surfaces. The tip surface may engage the corresponding surface before, or after, the load surface abuts the separate component. The provision of secondary load-transferring surfaces may reduce the stresses induced in certain parts of the tool during use and may thus increase the total load capacity of the tool.

The load sleeve may be secured on the mandrel. The terms "secured" and "securable" when describing the load sleeve may be made with respect to the mandrel. The terms "secured" and "securable" as used herein may refer to being restrained or fixed in one, two or three dimensions or degrees of freedom. As such, the load sleeve may be secured when it is prevented from moving in a single direction, e.g. from the first end towards the second end. When the load sleeve is secured on the mandrel, it may be prevented from moving towards the second end (i.e. from the first end); prevented from moving axially; and/or prevented from rotating about the mandrel axis.

The load sleeve may be directly secured on the mandrel. The inner surface of the load sleeve may be configured to engage the mandrel (e.g. the mounting surface) directly to secure the load sleeve. Accordingly, any description provided below relating to the engagement of the inner surface of the locking assembly and the mandrel may apply, mutatis mutandis to the inner surface of the load sleeve when the load sleeve is configured to engage the mandrel directly. When the inner surface of the load sleeve is configured to engage the mandrel directly, a locking assembly may not be required. Having the load sleeve engage the mandrel directly (i.e. without intermediary) may minimize the number of separate components required. In certain cases, it may also simplify assembly of the tool.

The load sleeve may be secured to the mandrel by means of a fastener, split ring fastener, wire windings, welding, brazing.

The load sleeve may comprise a split sleeve, securable adjacent the male threaded portion. Any discussion below relating to a split sleeve forming part of the locking assembly applies, mutatis mutandis to a split sleeve forming part of the load sleeve. In examples where the load sleeve comprises a split sleeve, the load sleeve may engage the mandrel directly and a locking assembly may not be required. The use of a split sleeve may provide a simple yet efficient method of securing the load sleeve onto the mandrel.

The load sleeve may be arranged to slide on the mandrel from the first or second end. Having the load sleeve slidingly engage the mandrel may facilitate quick and robust assembly of the tool on the tubing string.

The load sleeve may be arranged such that it is (automatically and/or simultaneously) secured on the mandrel when the separate component engages the pin connector of the tool. Engagement of the separate component on the male threaded portion of the mandrel may secure the load sleeve on the mandrel.

The load sleeve may be prevented from rotating relative to the mandrel by friction when the load sleeve is secured on the mandrel. The load sleeve may be prevented from rotating by means of friction between the load sleeve and mandrel; the load sleeve and the tool component; and/or the load sleeve and the locking assembly.

A portion of the load sleeve may be arranged to be trapped by the separate component and the mandrel or the locking assembly as the separate component engages the mandrel.

The load sleeve may be arranged such that, when the load sleeve is mounted on the mandrel and the separate component is engaged on the male threaded portion, a part of the load sleeve is trapped (e.g. sandwiched and/or pinched) between the load surface of the separate component and a surface fixed with respect to the mandrel such that the load sleeve is secured—for example such that friction prevents the load sleeve from rotating relative to the mandrel. The surface which is fixed relative to the mandrel may form part of the mandrel itself, the locking assembly and/or the tool component. It may be an axially-facing surface of any of these parts.

The friction forces may be caused by the axial forces (e.g. the forces induced by the screw thread connection) of the connector sub acting on the load sleeve.

Relying on friction to prevent rotation of the load sleeve relative to the mandrel may reduce the number of components required and simplify assembly of the tool.

The inner surface of the load sleeve and the outer surface of the mandrel (e.g. the mounting surface) may each comprise an engagement surface arranged to secure the load sleeve on the mandrel when the separate component is engaged on the male threaded portion. The engagement surfaces may be surfaces arranged at an oblique angle to the axis of the mandrel. The engagement surfaces may be arranged such that, when the load sleeve is mounted on the mandrel, the engagement surfaces secure the load sleeve.

The load sleeve may comprise a split sleeve comprising two half-sleeves.

The internal surface of the split load sleeve and external surface of the mandrel (e.g. the mounting surface) may comprise the engagement surfaces. When the load sleeve is mounted on the mandrel and a separate component is engaged on the pin connector, the separate component may urge the load sleeve axially towards the second end such that the engagement surfaces are brought into abutment.

The separate component may then prevent the load sleeve from moving axially towards the first end. The engagement surfaces may be arranged such that the two half-sleeves cannot be disconnected from the mandrel without moving axially towards the first end. Accordingly, when the load sleeve is mounted on the mandrel and a separate component is engaged on the pin connector, the engagement surfaces and separate component may prevent the half-sleeves from separating from the mandrel and thus secure the load sleeve.

The mandrel may comprise at least one of a groove and/or ridge. The inner surface of the split sleeve may comprise at least one of a groove and/or ridge engageable with the groove and/or ridge of the mandrel. The internal surfaces of the split sleeve and/or the external surface of the mandrel may comprise a castellated profile. The groove, ridge or castellated profile may provide the engagement surface (and hence one surface of the groove, ridge or castellated profile may be arranged at an oblique angle to the axis of the mandrel). The groove, ridge or castellated profiles may thus comprise a profile similar to half a dovetail join.

The load sleeve split sleeve may be arranged to engage the groove/ridge/castellated profile on the mandrel such that the obliquely-angled surfaces abut. When the separate component is engaged on the pin connector and the load sleeve is prevented from moving axially with respect to the mandrel, the two split sleeve halves may also be prevented from moving radially and separating.

The tool may further comprise: a locking assembly arranged to engage the mandrel and the load sleeve when the load sleeve is mounted on the mandrel to secure the load sleeve.

The locking assembly may facilitate the securing of the load sleeve relative to the mandrel. In some arrangements, the load sleeve may not engage the mandrel directly and the locking assembly may engage both the load sleeve and the mandrel to secure the load sleeve relative to the mandrel. The use of the locking assembly may facilitate a robust securement mechanism and ensure robust and efficient assembly of the tool.

The locking assembly may comprise a fastener configured to secure the load sleeve. In some examples, the locking assembly may comprise a pin, clip and/or alternative fastener arranged to secure the load sleeve on the mandrel. For example, if the load sleeve is a split-sleeve, the locking assembly may be a clip to secure the two half-sleeves together.

The locking assembly may be separate and/or separable from the mandrel and/or the load sleeve.

The locking assembly may be locatable between the mandrel and the load sleeve. The outer surface of the mandrel and the inner surface of the load sleeve may be configured such that, when the load sleeve is mounted on the mandrel, the locking assembly secures the load sleeve.

Part or all of the locking assembly may be locatable between the mandrel and the load sleeve. The locking assembly may be locatable between the mandrel and the load sleeve in a radial direction. The locking assembly may be arranged to be located partially within the mandrel (e.g. mounting surface) and partially within the load sleeve when the load sleeve is mounted on the mandrel, so as to bridge an interface between the mandrel and the load sleeve. Such an arrangement may provide a robust interface between the mandrel and load sleeve and the locking assembly, thus ensuring adequate load transfer between the parts.

The number of parts and geometry of the locking assembly may be selected such that the locking assembly has adequate torsional and axial strength for transferring loads between the load sleeve and the mandrel.

The locking assembly may comprise a split sleeve comprising two half-sleeves. The inner surface of the split sleeve may be configured to engage the mandrel. The load sleeve may be configured to engage the split sleeve, securing the load sleeve relative to the mandrel. The inner surface of the load sleeve may be configured to engage the split sleeve.

The locking assembly may further comprise a fastener to secure the two half-sleeves together. Alternatively, the load sleeve may be configured to hold the two half-sleeves together. The load sleeve may be configured to slide over the top of the split sleeve and maintain the two half-sleeves together.

The mandrel (e.g. the outer surface thereof) may comprise at least one of a groove and/or ridge. The inner surface of the split sleeve may comprise at least one of a groove and/or ridge engageable with the groove and/or ridge of the mandrel. The load sleeve may comprise a circumferential flange arranged to engage an edge of the split sleeve.

The inner surface of the split sleeve may comprise a plurality of parallel grooves (or ridges) e.g. arranged to form a crenelated profile. The mandrel may comprise a complementary or corresponding set of grooves (or ridges) such that the inner surface of the split sleeve engages the outer surface of the mandrel. The grooves and/or ridges may be arranged circumferentially or axially. The plurality of grooves of the split sleeve and mandrel may be arranged circumferentially to prevent axial relative motion between the mandrel and the split sleeve, or axially to prevent rotational relative movement of the mandrel and the split sleeve.

Circumferential grooves in the split sleeve and/or mandrel may extend around the entire circumference of the split sleeve/mandrel or may extend around only a part of the circumference of the mandrel and/or split sleeve. When circumferential grooves do not extend around the entire circumference of the split sleeve and/or mandrel, an axially-oriented raised section may be defined. The grooves and/or ridges may extend around only a part of the circumference of the mandrel and split sleeve so as to prevent relative movement between the split sleeve and the mandrel in an axial and a rotational direction.

The locking assembly may comprise a, or a plurality of, key(s) (e.g. locking member(s)) locatable between the mandrel and the load sleeve in order to secure the load sleeve.

The locking assembly may comprise a key. One of the mandrel and the load sleeve may comprise a cut-out matching the profile of the key. The other of the mandrel and the load sleeve may comprise a keyway with an open first end and a closed second end. The key and keyway may be configured such that the key can be located in the cut-out and be received in and traverse the keyway as the load sleeve is slid onto the mandrel, The tool may comprise a plurality of cut-outs. When located in the cut-out, the key may be prevented from moving in an axial and/or circumferential direction relative to the cut-out.

The tool may comprise a plurality of keyways in at least one of the mandrel and load sleeve. The keyways may be elongated slots. The keyways may be arranged axially with respect to the mandrel and/or load sleeve. The open first end may allow the key to enter the keyway, and the closed second end may prevent axial and circumferential movement of the key relative to the keyway once the key has reached the second end of the keyway. The load sleeve may be secured on the mandrel when the key reaches the closed end of the keyway The cut-outs may be spaced around the circumference of the mandrel and/or load sleeve. The cut-outs may be axially staggered.

The number and geometry of the cut-out and key pairs may be selected to ensure sufficient axial and torsional loads can be transferred between the load sleeve and the mandrel.

The tool component may be mounted on the mounting surface.

Illustrative examples of suitable tool components may include: a drill bit component; a slip; a directional drilling component; a drilling tractor; a stabiliser tool; a side-port circulating sub; a drilling jar; a torque reducing tool; a sliding friction reducing tool; a reamer component; a packer; an isolator; well testing apparatus; and a flow control device.

In order to be mountable on the tool, the tool component may be substantially tubular. The tool component may comprise an internal bore. The diameter of the internal bore may be equal to, or slight larger than, the diameter of the mounting surface. The internal bore of the tool component may be circular or may be non-circular—for example to match and engage with a non-circular outer profile of the mandrel.

The internal bore of the tool component may be located centrally and symmetrically within the tool component, or asymmetrically within the tool component.

The internal surface of the tool component may comprise a complementary surface feature to that on the mounting surface—configured to engage the feature on the mounting surface to locate and secure the tool component in position.

The tool may further comprise a connector sub, engageable or engaged with (the male threaded portion/pin connector at) the first end of the mandrel, i.e. the service connector.

The connector sub may comprise a box connector engageable or engaged with the male threaded portion of the mandrel and a pin connector or service connector at its other, free, end. The connector sub may facilitate connection with further component of a tubing string.

The outer surface, or profile thereof, of the connector sub may be profiled for being engaged by assembly equipment for connecting the tool as part of a string. The connector sub may be configured to be attached to the downhole tool before the downhole tool and connector sub assembly are connected to the rest of a tubing string. The connector sub may comprise a profile such that it can be gripped by equipment used to assemble a tubing string and may thus facilitate the inclusion of the downhole tool in a tubing string.

The connector sub may act as an extension for the tool and be of a length such that the length of the assembled tool and connector sub is equivalent to a standard length for a string component.

According to the disclosure is a tool assembly comprising a downhole tool as disclosed herein and a connector sub, engaged with the pin connector.

The tool may further comprise seals located between at least one of the load sleeve and the mandrel; the locking assembly and the mandrel; and/or the locking assembly and the load sleeve. Seals may be fluidic seals and may be provided for preventing the ingress of fluid present in the bore. Such seals may be arranged to prevent leak paths caused by differential pressures being provided between the internal bore of the mandrel and the annulus during use. Pressure differentials/gradients are typically encountered in downhole operations due to formation pressure and fluid flow.

Additionally, thread tightening load may also act to provide suitable sealing between parts (for example the load sleeve and the separate component) to avoid fluid leakage across pressure differentials. Accordingly the torque shoulder of the load sleeve and the male-threaded portion may be configured to provide, handle and maintain sufficient interface pressure to resist pressure differentials encountered in downhole operations.

The load sleeve; locking assembly, tool component and/or the mandrel (e.g. the mounting surface) may comprise grooves for locating a circumferential seal. The load sleeve and/or mandrel may comprise two grooves for locating two circumferential seals.

Further according to the disclosure is a connector. The connector may comprise a mandrel having first and second opposing ends. The mandrel may have an outer mounting surface. The first end may comprise a male threaded portion. The connector may further comprise a load sleeve defining a torque shoulder. The load sleeve may be mountable on the mandrel. The load sleeve may be securable adjacent the male threaded portion of the first end of the mandrel such that the torque shoulder and the male threaded portion define a pin connector to facilitate connection with a box connector of a separate component.

The connector may further comprise: a locking assembly arranged to engage the mandrel and the load sleeve when the load sleeve is mounted on the mandrel and secure the load sleeve.

Discussion relating to features of the tool which are in common with features of the connector applies to those corresponding features, mutatis mutandis.

Further according to the disclosure is a reamer, a drill string and/or a completion string comprising a tool or connector as described anywhere herein.

Further according to the disclosure is a method for assembling a tool. The tool may be as described herein. The method may comprise: mounting a tool component onto a mounting surface of a mandrel of a tool. The method may further comprise mounting a load sleeve on the mandrel. The method may further comprise securing the load sleeve adjacent a male threaded portion of a first end of the mandrel such that a torque shoulder of the load sleeve and the male threaded portion define a pin connector to facilitate connection with a box connector of a separate component.

The method may further comprise arranging a locking assembly to engage the mandrel and the load sleeve when the load sleeve is mounted on the mandrel and secure the load sleeve.

The method may further comprise: connecting a box connector of a separate component to the tool by screwing the box connector onto the male threaded portion of the tool.

The tool of any of the methods according to the disclosure may be a tool as described anywhere herein. Accordingly, any discussion relating to features of the tool inherently apply to methods for assembling and using the tool.

DETAILED DESCRIPTION OF THE DRAWINGS

Figure 1:
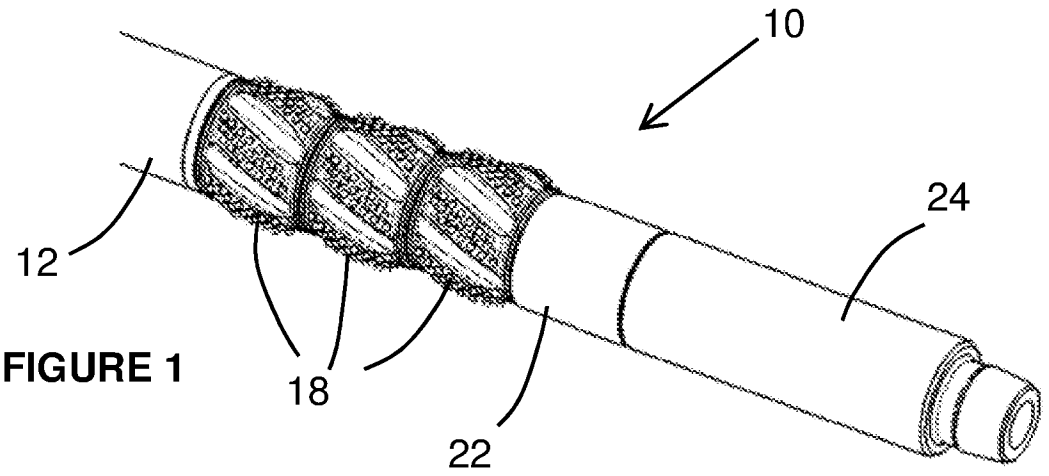
FIG. 1 is a perspective view of a tool according to the disclosure.

The present disclosure relates to downhole tools which can be assembled to define a pin connector to facilitate connection with a separate component. The pin connector may be provided in such a manner to facilitate assembly, maintenance etc. of the downhole tool, without or with minimal compromise to the ability of the tool to be connected to separate components in a robust manner.

The downhole tool of the present disclosure may comprise a wide range of tool components allowing the downhole tool to be used for a variety of purposes, as discussed above. In the below examples, the downhole tool is a roller reamer, however it is to be understood that the downhole tool of the disclosure is not limited as such. In the examples, the same reference numerals will be used to refer to corresponding features in different examples.

Figure 2:
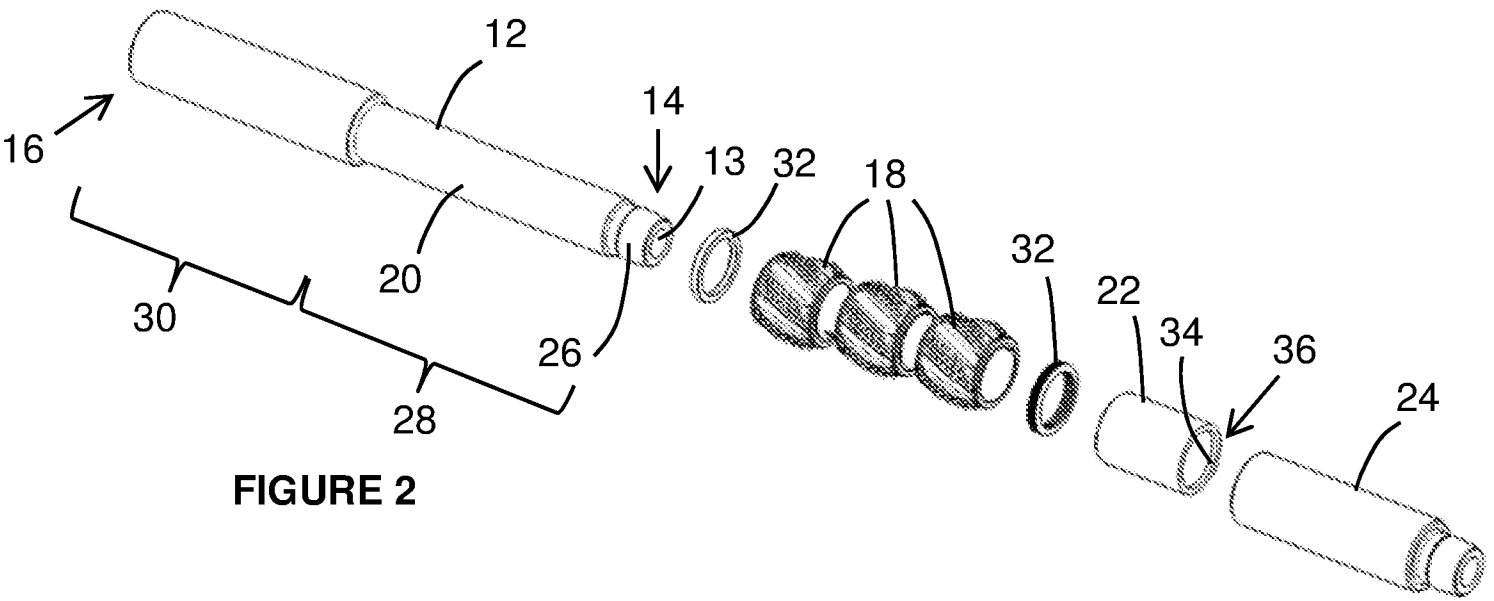
FIG. 2 is an exploded view of the tool of FIG. 1.

FIGS. 1 and 2 depict a tool 10 according to an example of the disclosure. In this example, the tool is a roller reamer for use in a downhole drilling operation. The tool 10 of FIGS. 1 and 2 comprises a mandrel 12 comprising a first 14 and a second end 16. The first end 14 has a male threaded portion 26. The mandrel has an outer mounting surface 20 and tool components 18 are mounted on the mounting surface 20. A load sleeve 22 is mounted on the mandrel 12, in this case on the mounting surface 20, and is secured adjacent the first end 14.

The mandrel 12 comprises an internal bore 13 for conveying fluid either to or from the well bore—for example for transporting drilling fluid from the surface to a drill bit.

In the arrangement of FIG. 1, a separate component is mounted on the male threaded portion 26 of the first end 14 of the tool 10. In this example the separate component is a connector sub 24; however in other examples the separate component may be another tubing string member, e.g. a further tool. The connector sub 24 is screwed onto the first end 14 of the tool and comprises a male threaded section at its free end.

In FIGS. 1 and 2, the tool components 18 are tubular roller reamer sleeves and, as such, the tool is a roller reamer. In a drill string, the roller reamer may be arranged behind a drill bit and may be used to help form the bore.

FIG. 2 depicts the tool 10 of FIG. 1 in an exploded arrangement. As can be seen from FIG. 2, the mandrel 12 comprises a first section 28 of a first diameter, towards the first end of the tool 14, and a second section 30 of a second, larger, diameter, towards the second end of the tool 16. The first section 28 comprises the mounting surface 20. The tool components 18 are slid onto the mounting surface from the first end 14. In this example, there are three tubular roller reamer sleeves, flanked on either side by two spacer rings 32. The internal diameters of the reamer sleeves are larger than the first diameter such that they can slide onto the tool 10, but smaller than the second diameter, such that they cannot slide off of the tool 10 via the second end 16.

The tool 10 components and spacer rings 32 slide onto the tool 10 and are located adjacent the interface between the first and second sections 28, 30, which forms a shoulder to hold the tool components 18 in position on the mounting surface 20.

The tool components 18 are secured on the mounting surface 20 by mounting features (not shown) present on both the mounting surface 20 and the internal surface of the tool components 18 and engage one another when the tool components 18 are slid onto the mounting surface 20.

The first end 14 comprises a male threaded portion 26. The male threaded portion 26 is tapered with a narrower diameter at its tip compared to its base. The threaded portion 26 is in accordance with an API standard, as would be found in a standard pin and box connector for used in downhole service connectors.

The load sleeve 22 defines a torque shoulder 36 and is provided to form part of the API standards-type pin connector formed by the tool 10. The torque shoulder 36 of the load sleeve 22 is for abutting the separate component and transferring loads therebetween.

The load sleeve 22 is mounted on the mounting surface 20 and is secured adjacent the male threaded portion 26 of the first end 14. In the present example the load sleeve 22 is slid onto the mounting surface 20 via the first end 14. As such, when a female box-connector of a connector sub 24 engages the male threaded portion 26 of the tool 10, an exposed, axially facing end surface of the torque shoulder 36—the load surface 34—abuts and engages a surface of the connector sub 24. This load surface 34 is arranged to transfer axial and rotational loads between the tool 10 and the connector sub 24.

In FIGS. 1 and 2, it can be seen that the connector sub 24 has a standard male pin connector portion at its end furthest from the tool 10.

Figure 3:
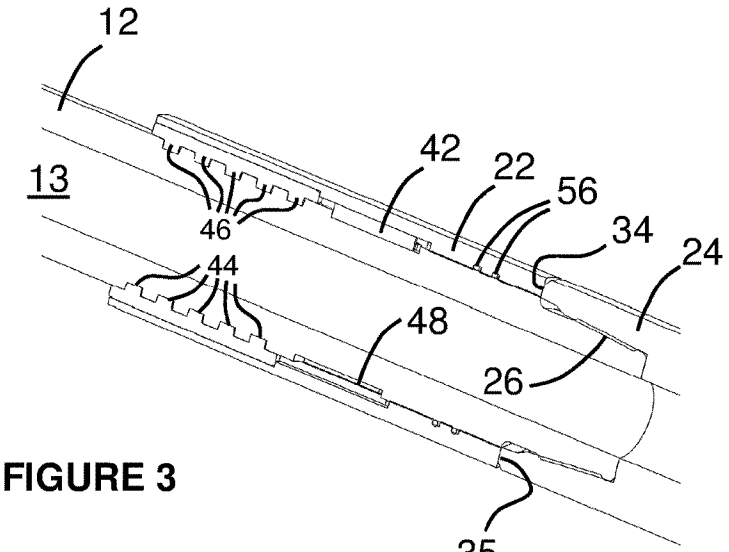
FIG. 3 is a cross-section view of a tool according to the disclosure.
Figure 5:
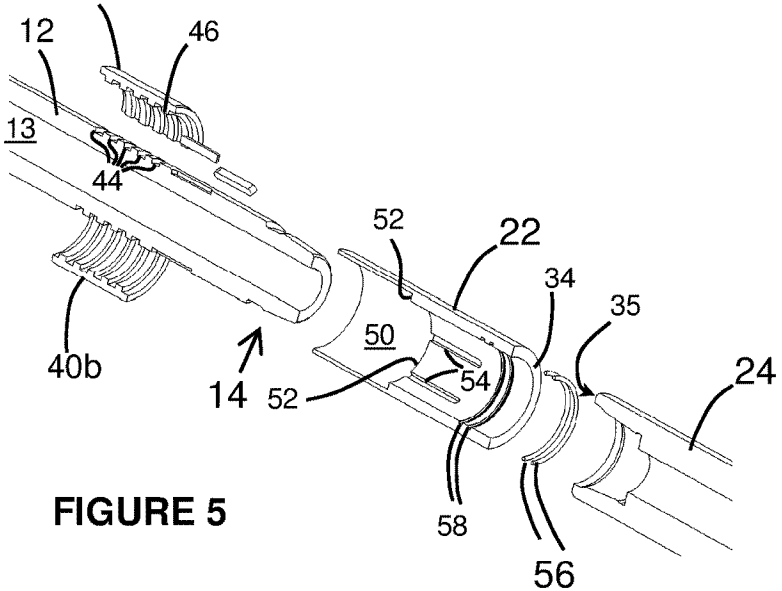
FIG. 5 is a cross sectional exploded view of the tool of FIG. 3.
Figure 4:
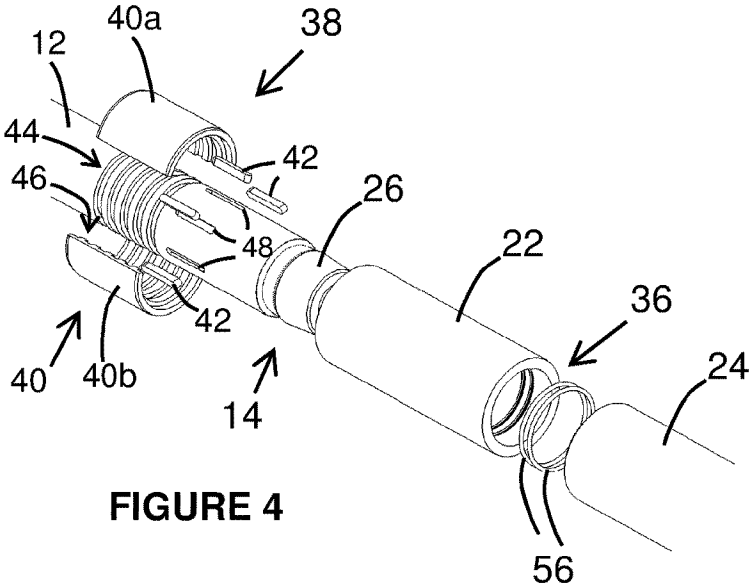
FIG. 4 is an exploded view of the tool of FIG. 3.

FIGS. 3 to 5 illustrate a further tool according to an example. FIG. 3 is a cross-section of the tool assembled and connected to a connector sub 24, FIG. 4 is an exploded view of the tool and FIG. 5 is a cross-sectional exploded view of the tool. In FIGS. 3 to 5 the mandrel is connected to a connector sub 24 by means of the pin connector facilitated by the first end 14 of the tool and a box connector of the connector sub 24. Features of the tool of FIGS. 3 to 5 which are common to the tools of any of the preceding Figures will not be described in detail, but it is to be understood that the comments made above apply, mutatis mutandis.

As with the example of FIG. 1, the tool comprises a mandrel 12 with a mounting surface 20. A load sleeve 22 is mountable on the mounting surface 20 and securable thereon. The load sleeve 22 defines a torque shoulder 36 providing a load surface 34 which is arranged to engage a corresponding surface 35 of the box connector of the connector sub 24. The load surface 34 of the load sleeve 22 and the corresponding surface 35 of the connector sub 24 are largely responsible for the transmission of load (both axial and torsional) between the mandrel and the connector sub 24.

In the example of FIGS. 3 to 5, the load sleeve 22 is secured on the mounting surface 20 by means of a locking assembly 38. The locking assembly 38 comprises a split sleeve 40 comprising two half-sleeves 40*a*, 40*b*. The locking assembly 38 further comprises a plurality of keys 42.

The locking assembly 38 is arranged to engage the mandrel 12 and the load sleeve 22. When the load sleeve 22 is mounted on the mandrel 12, the locking assembly 38 secures the load sleeve 22 with respect to the mandrel. The locking assembly 38 is located substantially between the mounting surface 20 and the load sleeve 22 and extends partially into both—thus the locking assembly 38 is located across the interface of the load sleeve 22 and mounting surface 20.

The mounting surface 20 is configured to receive the locking assembly 38 such that the split sleeve 40 and keys 42 protrude therefrom. Accordingly, the mounting surface 20 comprises a plurality of grooves 44 arranged to engage with corresponding ridges 46 (or grooves) present on the inner surface of both halves of the split ring 40. In this example the grooves 44 and ridges 46 are arranged to extend around the full circumference of the mounting surface 20. As such, once the split sleeve 40 is connected and engaged with the mandrel 12, the grooves 44 and ridges 46 secure the split sleeve 40 by preventing it from moving axially along the mandrel 12.

Similarly, the mounting surface 20 comprises a plurality of parallel, circumferentially-spaced cut-outs 48 arranged to receive the keys 42. The cut-outs 48 are sized so as to allow the keys 42 to be received therein and protrude from the surface of the mounting surface 20. The cut-outs 48 prevent the keys 42 from moving circumferentially and axially with respect to the mandrel 12.

The load sleeve 22 is configured to slide over the top of the mandrel 12 and locking assembly 38 from the first end 14 of the mandrel 12. The inner surface of the load sleeve 22 is arranged to engage the locking assembly 40. This interaction between the locking assembly 40 and the load sleeve 22 secures the load sleeve 22 with respect to the mandrel 12. In the present embodiment, once the load sleeve 22 is secured on the mounting surface 20 it is prevented from moving axially towards the second end 16 of the mandrel 12 and prevented from rotating.

The inner surface of the load sleeve 22 is configured to engage the locking assembly 38 such that the split sleeve 40 and keys 42 can be partially located therein, thus securing the load sleeve 22 relative to the mandrel 12. To this end, the inner surface of the load sleeve 22 comprises an area of reduced thickness 50 for receiving the split sleeve 40. The area of reduced thickness 50 may form a first tubular section of the load sleeve 22 with the same outer diameter as the rest of the load sleeve 22 but an internal diameter which is larger than that of the rest of the load sleeve 22. The area of reduced thickness 50 defines an internal circumferential flange 52 arranged to abut the end face of the split sleeve 40. The inner surface of the load sleeve 22 also comprises a plurality of parallel, axially-aligned keyways 54 arranged to receive the keys 42.

To assemble the tool the split sleeve 40 and keys are located in the corresponding features of the mounting surface 20 as described above. The load sleeve 22 is then mounted on the mandrel 12 by sliding the load sleeve 22 onto the mounting surface 20 and locking assembly 38. As the load sleeve 22 is slid over the mandrel 12 and locking assembly 38 from the first end 14 towards the second end 16, the portion of the split sleeve 40 protruding from the mounting surface 20 enters the area of reduced thickness 50 of the load sleeve 22 until the axially-facing end face of the split sleeve 40 abuts the internal circumferential flange 52 of the load sleeve 22. At this point, the load sleeve 22 is secured on the mandrel 12 and cannot move any further towards the second end 16 in the axial direction. As the split sleeve 40 enters the area of reduced thickness 50 and approaches the internal flange 52, the parts of the keys 42 protruding from the mounting surface 20 enter corresponding keyways 54 and traverse the keyways 54. The interaction between the keyways 54, keys 42 and cut-outs 48 prevent relative rotation between the load sleeve 22 and the mandrel 12. In this example, the keys 42 are also arranged to prevent the load sleeve 22 from moving axially towards the second end 16 once the keys 42 abut against the end surface of the keyways 54.

The tool of FIGS. 3 to 5 also includes two circumferential seals 56 which are located in circumferential seal grooves 58. The seals 56 are arranged to prevent the ingress of fluid from the bore between the load sleeve 22 and mandrel 12.

Figure 6:
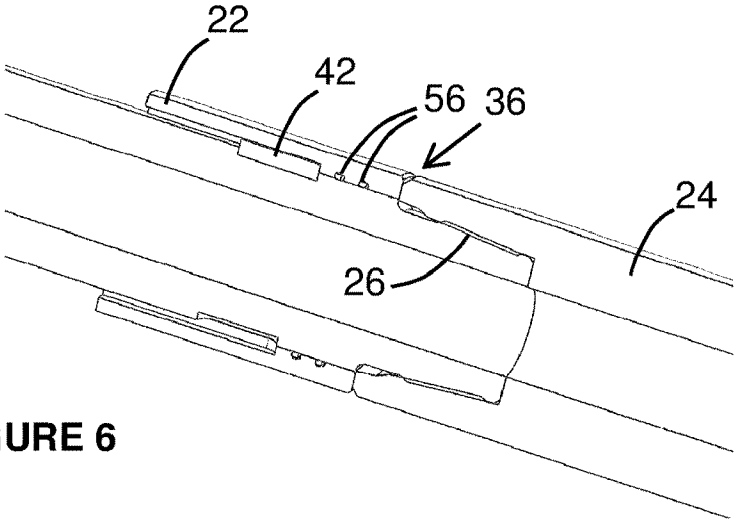
FIG. 6 is a cross-section of a further tool according to the disclosure.
Figure 8:
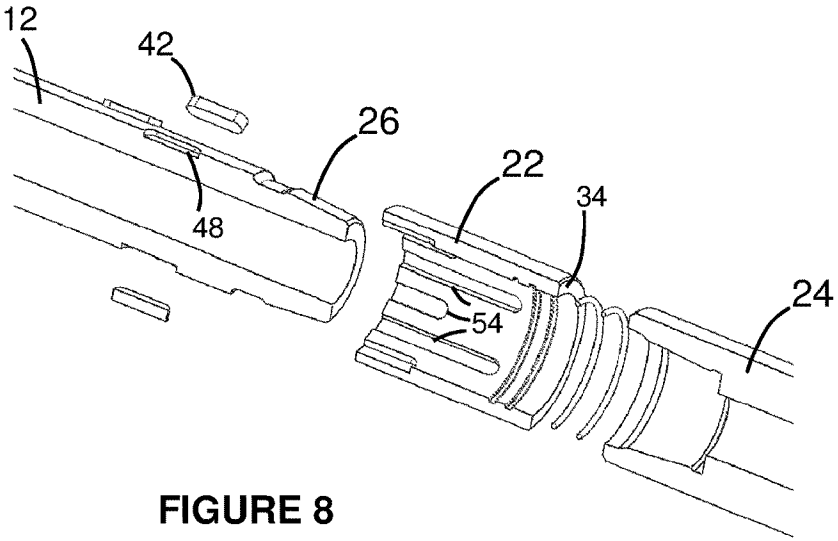
FIG. 8 is a cross sectional exploded view of the tool of FIG. 6.
Figure 7:
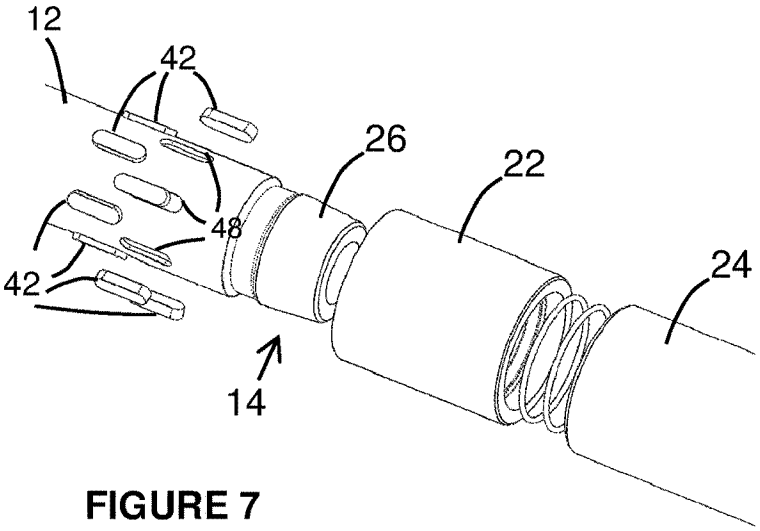
FIG. 7 is an exploded view of the tool of FIG. 6.

FIGS. 6 to 8 illustrate a further tool according to an example of the present disclosure. FIG. 6 is a cross-section of the tool assembled and including a connector sub 24, FIG. 7 is an exploded view of the tool and FIG. 8 is a cross-sectional exploded view of the tool. In FIGS. 6 to 8 the mandrel is connected to a connector sub 24 by means of a pin and box connection facilitated by the first end 14 of the tool and a box connector of the connector sub 24. Features of the tool of FIGS. 6 to 8 which are common to the tools of any of FIGS. 1 to 5 will not be described in detail, but it is to be understood that the comments made above apply here, mutatis mutandis.

The tool of FIGS. 6 to 8 comprises a mandrel 12, load sleeve 22 and locking assembly, as with the tool of FIGS. 3 to 5. However, the locking assembly of the presently-described tool does not comprise a split sleeve. Instead, the locking assembly comprises a plurality of keys 42 and the mounting surface 20 comprises a plurality of corresponding parallel, circumferentially-spaced, axially-staggered cut-outs 49 for receiving the keys 42 in the manner described in relation to FIGS. 3 to 5. Likewise, the internal surface of the load sleeve 22 does not comprise an area of reduced thickness but instead comprises only a series of axially-aligned, parallel keyways 54. The keyways 54 are of varying length according to the axial stagger of the corresponding cut-out 48.

In this tool, as before, the keys 42 are partially located in the cut-outs 48 and the load sleeve 22 is mounted on the mounting surface 20 by sliding the load sleeve 22 over the mandrel 12 and locking assembly from the first end 14. The keys 42 enter the keyways 54 and traverse the keyways 54 as the load sleeve 22 slides over the mandrel 12. The interaction between the keyways 54, the keys 42 and the cut-outs 48 prevent the load sleeve 22 from rotating relative to the mandrel 12 as soon as the keys 42 enter the keyways 54, since the elongated sides of the keys 42 abut corresponding surfaces on the cut-outs 48 and the keyways 54. Once the keys 42 reach the end of the keyways 54, the load sleeve 22 is prevented from moving any further in an axial direction towards the second end 16 of the mandrel 12, since the curved axial ends of the keys 42 abut corresponding surfaces of the cut-outs 48 and the keyways 54.

Figure 10:
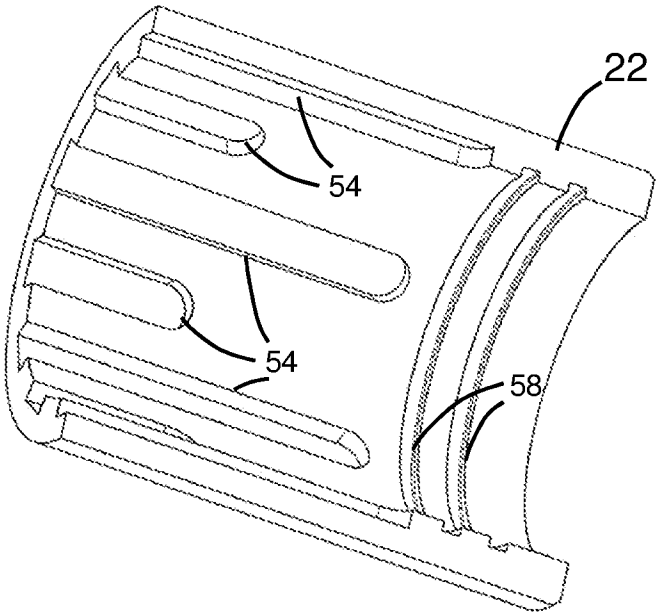
FIG. 10 is a cross-section of the load sleeve of the tool of FIG. 6.
Figure 9:
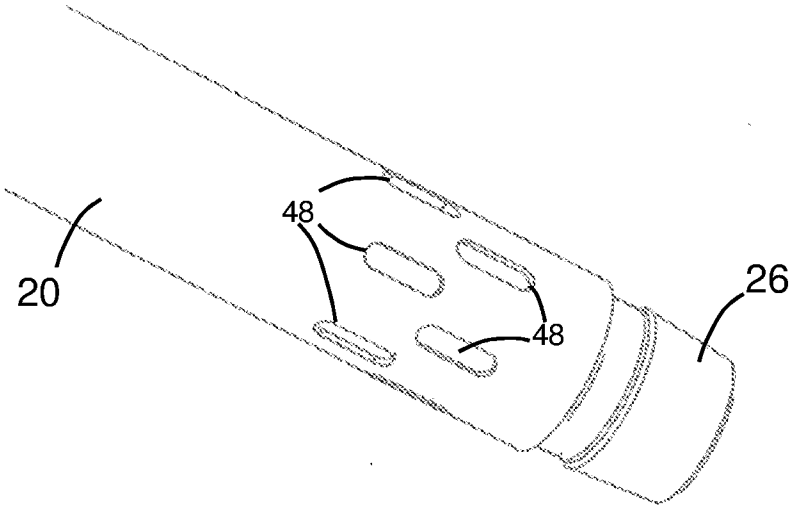
FIG. 9 is a perspective view of the mandrel of the tool of FIG. 6.

FIGS. 9 and 10 show the mandrel 12 and load sleeve 22 of the tool of FIGS. 6 to 8, respectively.

Figure 12:
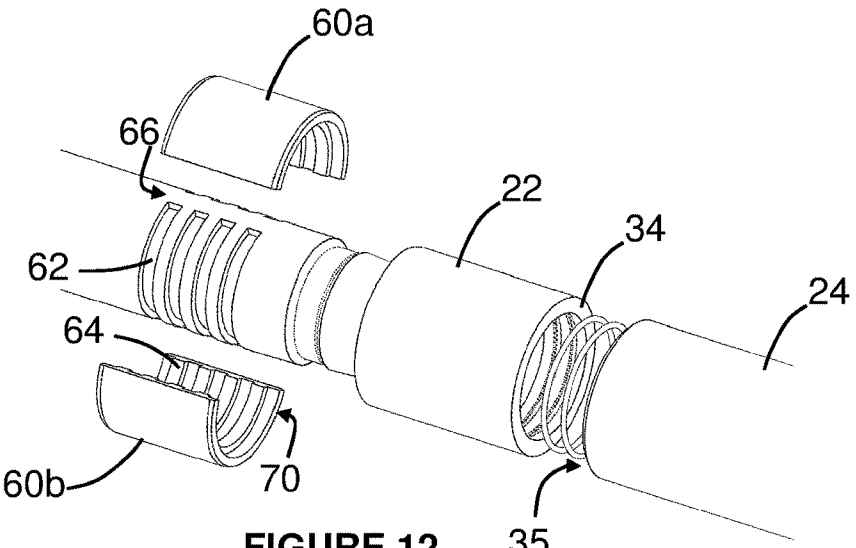
FIG. 12 is an exploded view of the tool of FIG. 11.
Figure 11:
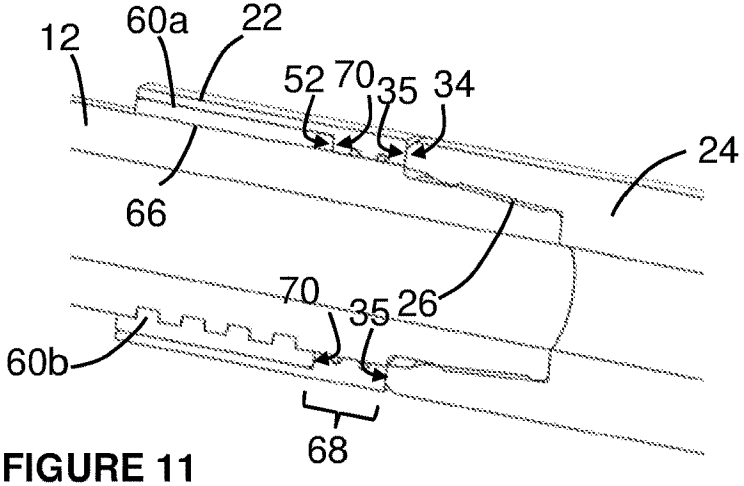
FIG. 11 is a cross-section of a further tool according to the disclosure.

FIGS. 11 and 12 show a further tool according to an example of the present disclosure. FIG. 11 is a cross-section of the tool. FIG. 12 is an exploded view of the tool and connector sub 24. Features of the tool of FIGS. 11 and 12 which are common to the tools of any of the preceding Figures will not be described in detail, but it is to be understood that the comments made above apply here, mutatis mutandis.

In the tool of FIGS. 11 and 12 the locking assembly comprises a split sleeve 60 comprising a first and second half-sleeve 60*a*, 60*b*. As in the tool of FIGS. 3 to 5, the mounting surface 20 comprises a plurality of grooves 62 arranged to engage with corresponding protrusions in the form of ridges 64 on the inner surface of the split sleeve 60. However, in the tool of FIGS. 11 and 12, the grooves 62 do not extend around the entire circumference of the mounting surface 20. Instead, the grooves extend 62 around the majority, but not all, of the mounting surface 20 (for example between 80% to 95%, or about 85% or 90%). Accordingly, as can be seen in FIGS. 11 and 12, an axially-oriented raised section/region 66 of the mounting surface 20 does not comprise any grooves 62. Accordingly, the inner surface of the split sleeve 60 has a corresponding profile and the ridges 64 do not extend around the entire circumference of the split sleeve 60. The inner surface of the split sleeve 60 therefore comprises an axial region which does not comprise any protrusions (ridges 64). This region is visible and the absence of any ridges 64 can be noted on the upper side of the split sleeve 60*a* as illustrated in FIG. 11.

As noted above, the circumferential grooves 62 and ridges 64 are arranged to prevent relative axial movement of the split sleeve 60 relative to the mandrel 12. The grooves 62 and ridges 64 of the tool of FIGS. 11 and 12, however, are also configured to prevent relative rotation between the split sleeve 60 and the mandrel 12, since the end faces of the grooves 62 and ridges 64 abut and prevent relative movement in the rotational direction. As such, the split sleeve of FIGS. 11 and 12 is prevented from both axial and rotational relative movement with respect to the mandrel 12.

In this tool, the load sleeve 22 engages the split sleeve 60 by means of an internal flange 52 present on the inner surface of the load sleeve. This internal flange abuts an axial end face 70 of the split sleeve 60. Accordingly, the split sleeve 60 prevents further axial movement of the load sleeve 22 towards the second end 16 when the load sleeve 22 abuts the split sleeve 60.

Furthermore, a portion of the load sleeve 68 is axially located between the locking assembly (split sleeve 60) and the female box connector component of the connector sub 24. Accordingly, as the connector sub 24 is connected to the mandrel by screwing the connector sub 24 onto the male threaded portion 26, this portion of the load sleeve 68 becomes trapped/sandwiched/pinched between the axial end face 70 of the split sleeve 60 and an axial exposed end surface 35 of the connector sub 24. As the connector sub 24 is forced axially towards the tool 10, or rotated in a direction which acts to further engage the male threaded portion 26 and the box connector of the connector sub 24, axial forces are induced which act to force the load sleeve 22 against the locking assembly. The portion 68 of the load sleeve 22 is thus trapped and the frictional forces prevent the load sleeve 22 from rotating relative to the split sleeve 60, and hence the mandrel 12.

Figure 14:
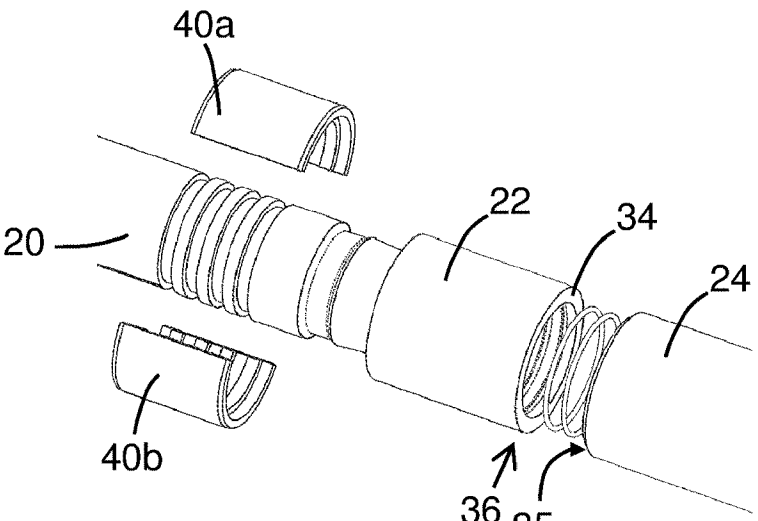
FIG. 14 is an exploded view of the tool of FIG. 13.
Figure 13:
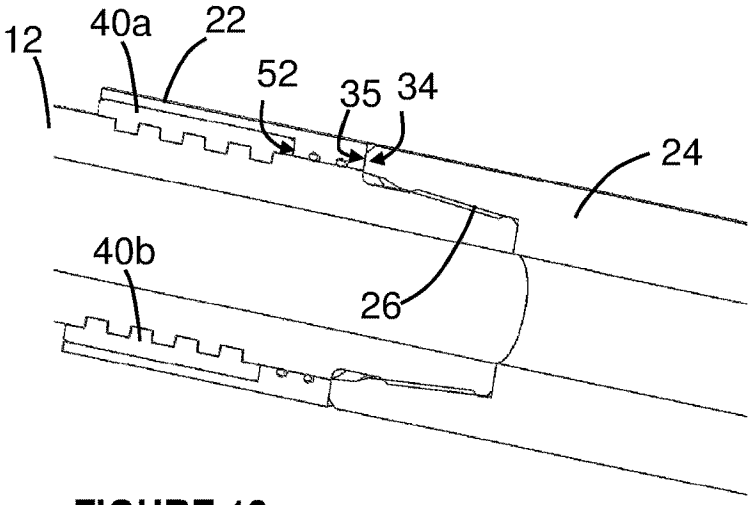
FIG. 13 is a cross-section of a further tool according to the disclosure.
Figure 15:
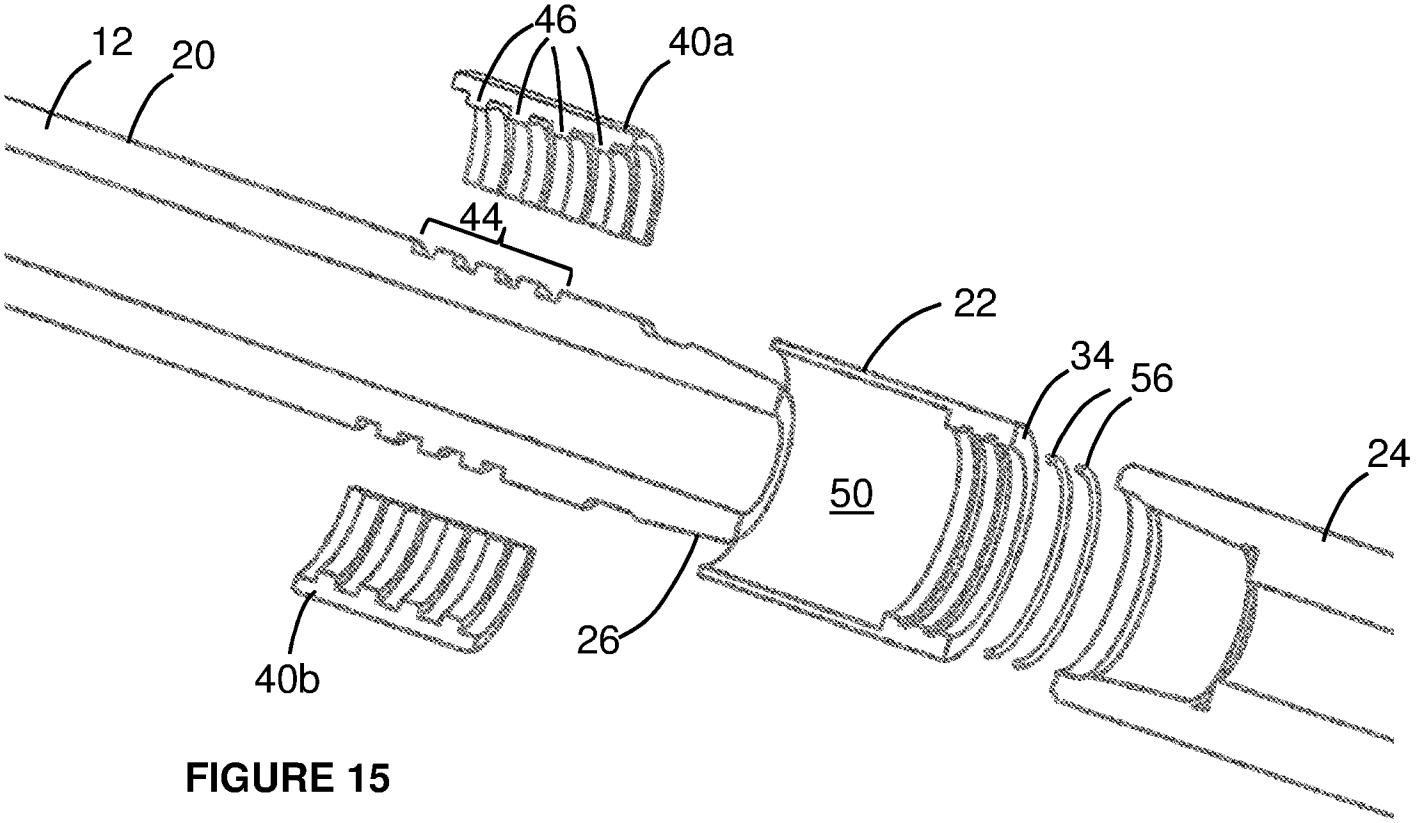
FIG. 15 is a cross-sectional exploded view of the tool of FIG. 13.

FIGS. 13 to 15 show cross-sectional, exploded and exploded cross-sectional views, respectively, of a further tool. As before, features of the tool of FIGS. 13 to 15 that are common to the tools of any of the preceding Figures will not be described in detail, but it is to be understood that the comments made above apply, mutatis mutandis.

In this tool, the locking assembly comprises only a split sleeve 40. The mounting surface 20 has circumferential grooves 44 which extend around the entire circumference of the mandrel. The locking assembly comprises a split sleeve 40 comprising two sleeve-halves 40*a*, 40*b* which have corresponding circumferential ridges extending around the entire circumference of the split sleeve 40. As such, the split ring 40 is as described with reference to FIGS. 3 to 5, and the mounting surface 20 is as described with reference to FIGS. 3 to 5, albeit without the cut-outs 42, since the locking assembly does not comprise any keys. The split sleeve 40 is therefore prevented from moving axially with respect to the mandrel 12, and the load sleeve 22 (which engages the split sleeve 40 by means of an internal flange 52) is prevented from moving axially with respect to the mandrel 12.

Although the split sleeve 40 (locking assembly) is constrained only in an axial direction, the split sleeve 40 and load sleeve 22 may be unable to rotate relative to each other and relative to the mandrel 12 due to friction forces during use. When the connector sub 24 is engaged on the male threaded portion 26, the load surface 35 of the separate component may abut the load surface 34 of the load sleeve 22, thus forcing the load sleeve 22 axially against the split sleeve 40 which, in turn, is forced against the mandrel 12. This interaction may create high friction forces which, in turn, may prevent the split sleeve 40 and load sleeve 22 from rotating relative to each other and relative to the mandrel 12. Accordingly, torsional forces may also be able to be transferred through this connection.

Figure 17:
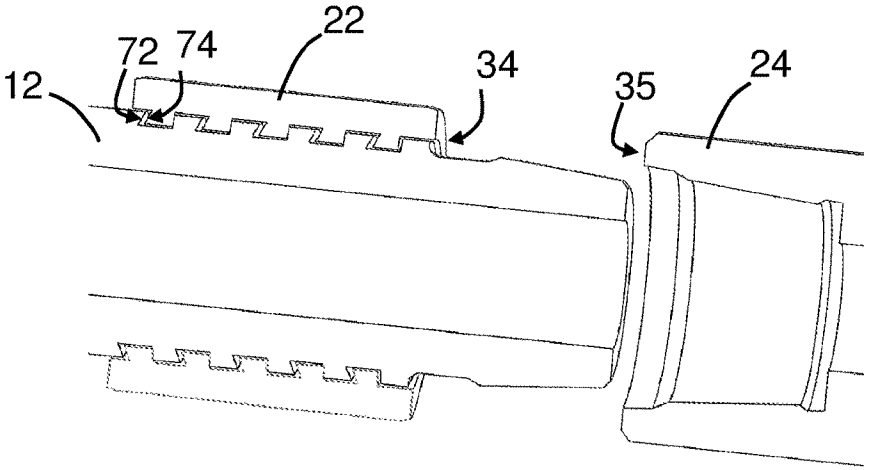
FIG. 17 is a partially assembled view of the tool of FIG. 16.
Figure 16:
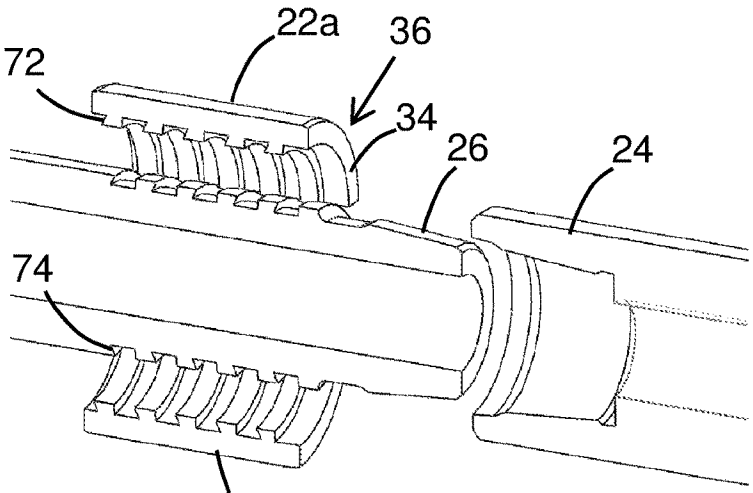
FIG. 16 is a disassembled view of a further tool according to the disclosure.
Figure 18:
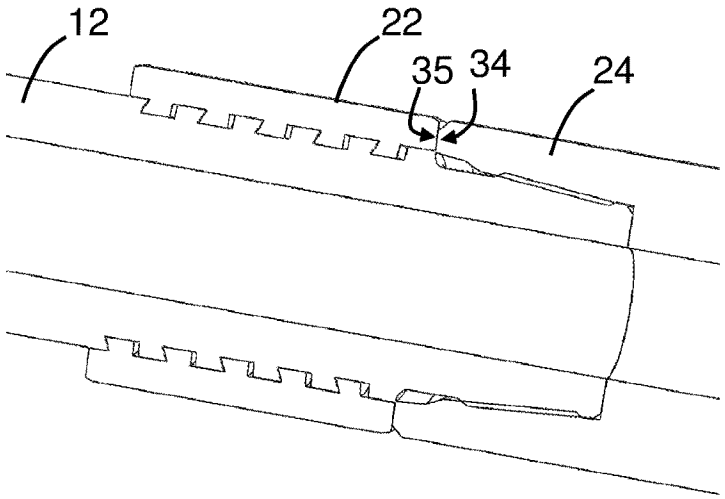
FIG. 18 is an assembled view of the tool of FIG. 16.

FIGS. 16 to 18 illustrate a cross-sectional disassembled, partially assembled and fully assembled tool, respectively. In the tool of FIGS. 16 to 18, the load sleeve 22 is arranged to be secured on the mandrel 12 when a separate component 24 engages the pin connector of the tool, i.e. without the use of a separate locking assembly. As with the previous tools, the load sleeve 22 defines a torque shoulder 36 such that the torque shoulder 36 and male threaded portion define a pin connector to facilitate connection with a box connector of a separate component 24.

The load sleeve 22 is a split sleeve comprising two half-sleeves 22*a*, 22*b*. The inner surface of the load sleeve 22 and the outer surface of the mandrel 12 comprise complementary castellated profiles, each formed of a plurality of corresponding ridges and grooves. The surface 72, 74 of each ridge of the load sleeve 22 and groove of the mandrel 12 arranged closest to the second end 16 of the mandrel is an engagement surface. Each engagement surface 72, 74 is arranged at an oblique angle to the axis of the mandrel 12, towards the first end 14 (i.e. the engagement surfaces 72, 74 are arranged such that as the radial distance from the axis increases, the surface gets closer to the first end 14).

In FIG. 17 the load sleeve 22 is partially mounted on the mandrel 12. The two half-sleeves have been moved radially to engage the castellated surface of the mandrel 12. As can be seen, there is a small gap between the two engagement surfaces 72, 74.

In order to fully engage and secure the load sleeve 22 on the mandrel, the load sleeve 22 must be moved axially towards the second end, such that the two obliquely-angled surfaces abut. This is automatically achieved when the separate component 24 is engaged on the male threaded portion 26. As the separate component 24 is mounted on the male threaded portion 26 of the mandrel 12, it abuts the load surface 34 of the load sleeve 22 and urges the load sleeve 22 towards the second end 16 of the mandrel 12. This in turn urges the engagement surfaces 72, 74 into engagement. When the separate component 24 is fully mounted on the pin connector of the mandrel 12, the load sleeve 22 is as shown in FIG. 18 with the engagement surfaces 72, 74 engaged.

When the half-sleeves 22*a* 22*b* are fully engaged with the mandrel 12 as shown in FIG. 18, the radially-innermost tips of the ridges of the load sleeve 22 are located radially under a portion of the mandrel 12. As such, in order to disengage each half-sleeve 22*a* 22*b* from the mandrel, they must move axially towards the first end 14 to permit the load half-sleeves 22*a*, 22*b* to move radially away from the mandrel 12. When in this position, the two half-sleeves 22*a*, 22*b* of the load sleeve 22 are unable to disengage and leave the mandrel 12 moving only in a radial direction. When the separate component 24 is engaged on the pin connector of the tool, it prevents the load sleeve 22 from such axial movement. Accordingly, the load sleeve 22 is unable to disengage the mandrel 12 and is automatically secured on the mandrel 12 when a separate component engages the pin connector of the separate component 24.

The present invention has been described purely by way of example. Modifications in detail may be made to the present invention within the scope of the claims as appended hereto.

What is claimed is:

1. A downhole tool, comprising:

a mandrel having first and second opposing ends and an outer mounting surface, the first end comprising a male threaded portion;

a tool component mountable on the mounting surface by sliding said tool component onto the outer mounting surface from the first end of the mandrel;

a load sleeve defining a torque shoulder, wherein the load sleeve is mountable on the mandrel and securable adjacent the male threaded portion of the first end of the mandrel such that the torque shoulder and the male threaded portion define a pin connector to facilitate connection with a box connector of a separate component; and, a locking assembly locatable between the mandrel and the load sleeve, wherein the locking assembly comprises a split sleeve comprising two half-sleeves, an inner surface of each half-sleeve comprising a plurality of grooves or ridges arranged to form a castellated profile, and the outer mounting surface comprising a corresponding plurality of grooves or ridges arranged to form a complimentary castellated profile, such that when the load sleeve is mounted on the mandrel and the separate component is engaged on the pin connector, the grooves or ridges of the inner surface of each half sleeve of the locking assembly and the complimentary grooves or ridges of the outer mounting surface are urged into engagement with one and other, with the grooves or ridges of each half sleeve, the corresponding grooves or ridges of the outer mounting surface, load sleeve and separate component preventing the half-sleeves of the locking assembly from separating from the mandrel.

2. The tool of claim 1, wherein the first end of the mandrel comprises the male threaded portion without a separate load-bearing shoulder.

3. The tool of claim 1, wherein the load sleeve is securable on the mandrel such that the load sleeve holds the tool component in place on the outer mounting surface.

4. The tool of claim 1, wherein a shoulder is defined at an edge of the outer mounting surface and is arranged to abut the tool component mounted on the outer mounting surface.

5. The tool of claim 1, wherein the load sleeve is separable with respect to the mandrel.

6. The tool of claim 1, wherein the torque shoulder comprises an end surface arranged to abut a corresponding end surface of the separate component and transfer axial and/or torsional loads therebetween, wherein the end surface is an axially-facing end face of the load sleeve adjacent the first end of the mandrel when the load sleeve is secured on the mandrel.

7. The tool of claim 1, wherein the load sleeve is prevented from at least one of:

moving from the first end towards the second end of the mandrel when the load sleeve is secured on the mandrel; and rotating about a mandrel axis when the load sleeve is secured on the mandrel.

8. The tool of claim 1, wherein the load sleeve is arranged such that it is secured on the mandrel when the separate component engages the pin connector of the tool.

9. The tool of claim 1, wherein the load sleeve comprises a circumferential flange arranged to engage an edge of the split sleeve.

10. The tool of claim 1, wherein the plurality of grooves or ridges of each half sleeve and the corresponding grooves or ridges of the outer mounting surface extend circumferentially; or the at plurality of grooves or ridges of each half sleeve and the corresponding plurality of grooves or ridges of the outer mounting surface extend only partially circumferentially;

so as to prevent relative movement between the split sleeve and the mandrel in an axial and a rotational direction.

11. The tool of claim 1, wherein the locking assembly further comprises a key;

the mandrel comprises a cut-out matching a profile of the key;

the load sleeve comprises a keyway with an open first end and a closed second end; and the key and keyway are configured such that the key can be located in the cut-out and be received in and traverse the keyway as the load sleeve is slid onto the mandrel.

12. The tool of claim 1, wherein the tool component comprises an internal bore, which is located asymmetrically within the tool component.

13. The tool of claim 1, further comprising the separate component, wherein the separate component is a connector sub, engageable with the first end of the mandrel wherein the outer surface of the connector sub is profiled for being engaged by assembly equipment for connecting the tool as part of a string.

14. A method for assembling a downhole tool, the method comprising:

mounting a tool component onto an outer mounting surface of a mandrel of a tool;

mounting a lock assembly onto the mounting surface;

mounting a load sleeve on the mandrel; and securing the load sleeve adjacent a male threaded portion of a first end of the mandrel such that a torque shoulder of the load sleeve and the male threaded portion define a pin connector to facilitate connection with a box connector of a separate component, wherein the lock assembly comprises a split sleeve comprising two half-sleeves, an inner surface of each half-sleeve comprising a plurality of grooves or ridges arranged to form a castellated profile, and the outer mounting surface comprising a corresponding plurality of grooves or ridges arranged to form a complimentary castellated profile, such that when the load sleeve is mounted on the mandrel and the separate component is engaged on the pin connector, the grooves or ridges of the inner surface of each half sleeve of the locking assembly and the and the corresponding grooves or ridges of the outer mounting surface are urged into engagement with one and other, with the grooves or ridges of each half sleeve, the corresponding grooves or ridges of the outer mounting surface, the load sleeve and separate component preventing the half-sleeves from separating from the mandrel.

* * * * *